US010390418B2

(12) United States Patent
Song et al.

(10) Patent No.: US 10,390,418 B2
(45) Date of Patent: Aug. 20, 2019

(54) BEAM ENERGY DISPERSION ADJUSTING MECHANISM FOR SUPERCONDUCTING PROTON CYCLOTRON

(71) Applicant: HEFEI CAS ION MEDICAL AND TECHNICAL DEVICES CO., LTD, Hefei, Anhui (CN)

(72) Inventors: Yuntao Song, Anhui (CN); Jinxing Zheng, Anhui (CN); Manfen Han, Anhui (CN); Wuquan Zhang, Anhui (CN); Junsong Shen, Anhui (CN); Yonghua Chen, Anhui (CN); Feng Jiang, Anhui (CN); Bo Zhi, Anhui (CN); Ming Li, Anhui (CN); Xianhu Zeng, Anhui (CN)

(73) Assignee: HEFEI CAS ION MEDICAL AND TECHNICAL DEVICES CO., LTD., Hefei (CN)

( * ) Notice: Subject to any disclaimer, the term of this patent is extended or adjusted under 35 U.S.C. 154(b) by 0 days.

(21) Appl. No.: 16/122,723

(22) Filed: Sep. 5, 2018

(65) Prior Publication Data

US 2019/0029100 A1 Jan. 24, 2019

Related U.S. Application Data

(63) Continuation of application No. PCT/CN2017/106992, filed on Oct. 20, 2017.

(30) Foreign Application Priority Data

Jul. 4, 2017 (CN) ..... 2017 1 0537935

(51) Int. Cl.

| | |
|---|---|
| ***H05H 7/00*** | (2006.01) |
| *H05H 13/00* | (2006.01) |
| *H05H 13/02* | (2006.01) |

(52) U.S. Cl.
CPC ..... *H05H 7/001* (2013.01); *H05H 13/005* (2013.01); *H05H 13/02* (2013.01); *H05H 2007/004* (2013.01)

(58) Field of Classification Search
CPC ..... H05H 7/001; H05H 7/007
(Continued)

(56) References Cited

U.S. PATENT DOCUMENTS

| | | | | |
|---|---|---|---|---|
| 3,728,463 | A * | 4/1973 | Kullmann | H01B 12/00 174/12 R |
| 2014/0374617 | A1 | 12/2014 | Kabasawa et al. | |
| 2016/0353562 | A1 * | 12/2016 | Antaya | H01F 6/06 |

FOREIGN PATENT DOCUMENTS

| | | |
|---|---|---|
| CN | 103517537 A | 1/2014 |
| CN | 205883687 U | 1/2017 |
| CN | 206908933 U | 1/2018 |

OTHER PUBLICATIONS

ChenNan et al , Beam-energy-spread adjustment usingcell-timing asynchronization , Apr. 30, 2016.

(Continued)

*Primary Examiner* — Jason L McCormack
(74) *Attorney, Agent, or Firm* — Wayne & Ken, LLC; Tony Hom

(57) ABSTRACT

Disclosed is a beam energy dispersion adjusting mechanism for superconducting proton cyclotron. The adjusting mechanism includes a vacuum cavity, bases are symmetrically mounted on outer walls of four faces of the vacuum cavity in horizontal and vertical directions, an electric cylinder and a transmission mechanism are mounted on each of the four bases, a jaws block and a position fixing plate are correspondingly provided on an inner wall of the vacuum cavity at each face. The transmission mechanism includes an oil-free sleeve, a moving connecting rod onto which the position fixing plate is fixed, a corrugated pipe, and an (Continued)

electric cylinder connecting block whose both ends are screwed with the moving connecting rod and the electric cylinder, the jaws block is fixedly connected with the position fixing plate. The disclosure utilizes the electric cylinder to drive the jaws block to complete specified linear displacement, and satisfies back-end beam quality requirements.

6 Claims, 3 Drawing Sheets

(58) Field of Classification Search
USPC ..... 250/306, 307, 311, 396
See application file for complete search history.

(56) References Cited

OTHER PUBLICATIONS

Xu Jianming , The Studies for Adjustable Energy of Proton Beams From Proton Linear Accelerator, Jan. 31, 1983.

* cited by examiner

BEAM ENERGY DISPERSION ADJUSTING MECHANISM FOR SUPERCONDUCTING PROTON CYCLOTRON

CROSS-REFERENCE TO RELATED APPLICATIONS

This application is a continuation of International Application No. PCT/CN2017/106992 with a filing date of Oct. 20, 2017, designating the United States, now pending, and further claims to Chinese application No. 201710537935.7 with a filing date of Jul. 4, 2017. The content of the aforementioned applications, including any intervening amendments thereto, are incorporated herein by reference.

TECHNICAL FIELD

The disclosure belongs to the technical field of superconducting proton cyclotron device engineering, and relates to a beam energy dispersion adjusting mechanism for a superconducting proton cyclotron, and more particularly to an adjustment mechanism capable of controlling the degree of beam energy spread with high precision.

BACKGROUND

A superconducting accelerator is an accelerator that accelerates particles with a superconducting acceleration cavity or main magnet, and mainly includes a superconducting linear accelerator, a superconducting cyclotron, and a superconducting synchrotron. Because of its small volume, strong average flow, continuous beams, and ability to accelerate a variety of particles, the superconducting cyclotron has been widely used in physical research, aerospace, biological medicine and other fields. For example, the proton beam can simulate the radiation environment of outer space, and can be used as an effective method for aerospace single-particle effect and instrument anti-radiation detection. The ionic radius of a heavy ion beam is selective and can be used to manufacture nuclear membrane pores. The superconducting proton cyclotron device is mainly composed of an accelerator and a series of beam-transporting components. As the beam energy produced is fixed, after the proton beam has been deflected by a two-pole magnet during the beam-transporting process, protons with a higher degree of energy spread have a larger amplitude on the radial deviating beam central track. In order to safely and efficiently adjust beam energy spread to obtain an ideal Bragg peak, it is necessary to design an adjustment mechanism capable of controlling beam energy spread with high precision so as to satisfy back-end beam quality requirements.

SUMMARY OF THE PRESENT INVENTION

The present disclosure is to provide a beam energy dispersion adjusting mechanism for a superconducting proton cyclotron so as to achieve an ideal Bragg peak and to satisfy back-end beam quality requirements.

The purpose of the present disclosure can be achieved by the following technical solution:

a beam energy dispersion adjusting mechanism for a superconducting proton cyclotron, including a vacuum cavity, where the vacuum cavity has four faces, a base is mounted on an outer wall of the vacuum cavity at each face; four bases are symmetrically provided in horizontal and vertical directions respectively; an electric cylinder and a transmission mechanism are mounted on each of the four bases; a jaws block and a position fixing plate are correspondingly provided on an inner wall of the vacuum cavity at each face; the transmission mechanism includes an oil-free sleeve, a moving connecting rod, a corrugated pipe and an electric cylinder connecting block; both ends of the electric cylinder connecting block are respectively connected with the moving connecting rod and the electric cylinder through threads; the position fixing plate is fixed onto the moving connecting rod, and the jaws block is fixedly connected with the position fixing plate.

A front cover and a rear cover are respectively mounted on a first side and a second side of the vacuum cavity; a lower part of the vacuum cavity is mounted on a support device, the support device includes an upper support square tube and a lower support square tube, and the upper and lower support square tubes are connected through a screw.

The oil-free sleeve is fixed onto the inner wall of the vacuum cavity; both ends of corrugated pipe are respectively fixed onto the outer wall of the vacuum cavity and the electric cylinder connecting block through flanges; the moving connecting rod is provided within the corrugated pipe and the oil-free sleeve.

The jaws block is insulated from the position fixing plate by a non-metallic material coated on a surface of the jaws block; the position fixing plate is mounted on a guide rod, and the guide rod is fixed onto the inner wall of the vacuum cavity.

The electric cylinder drives the moving connecting rod so as to drive the jaws block to perform a linear motion.

The adjustment steps of the beam energy dispersion adjusting mechanism include:

connecting the electric cylinder to a controller; reading a positional data from a database and sending a position command to the electric cylinder by the controller; driving the moving connecting rod through a corresponding action of the electric cylinder so as to drive the jaws block to perform the linear motion; and independently driving the each jaws block placed in the horizontal and vertical directions by the electric cylinder; and recording a linear displacement of the jaws block through a self-contained encoder of the electric cylinder and feeding it back into the controller, so as to control the energy spread of proton beam.

The disclosure has the following beneficial effects: the present disclosure uses the electric cylinder to drive the jaws block to complete a specified linear displacement, has a compact space in structure with high transmission efficiency, and can functionally adjust the degree of proton beam energy spread with high precision, to obtain an ideal Bragg peak and satisfy back-end beam quality requirements.

BRIEF DESCRIPTION OF THE DRAWINGS

In order to facilitate the understanding of those skilled in the art, the present disclosure will be further described below in combination with the accompanying drawings.

DETAILED DESCRIPTION OF THE DISCLOSURE

The technical solution of the present disclosure will be clearly and completely described below with reference to the embodiments. It is obvious that the described embodiments are only a part of the embodiments of the present disclosure, rather than all of the embodiments. All other embodiments obtained by those of ordinary skill in the art based on the embodiments of the present disclosure without creative efforts are within the scope of protection of the present disclosure.

Figure 1:
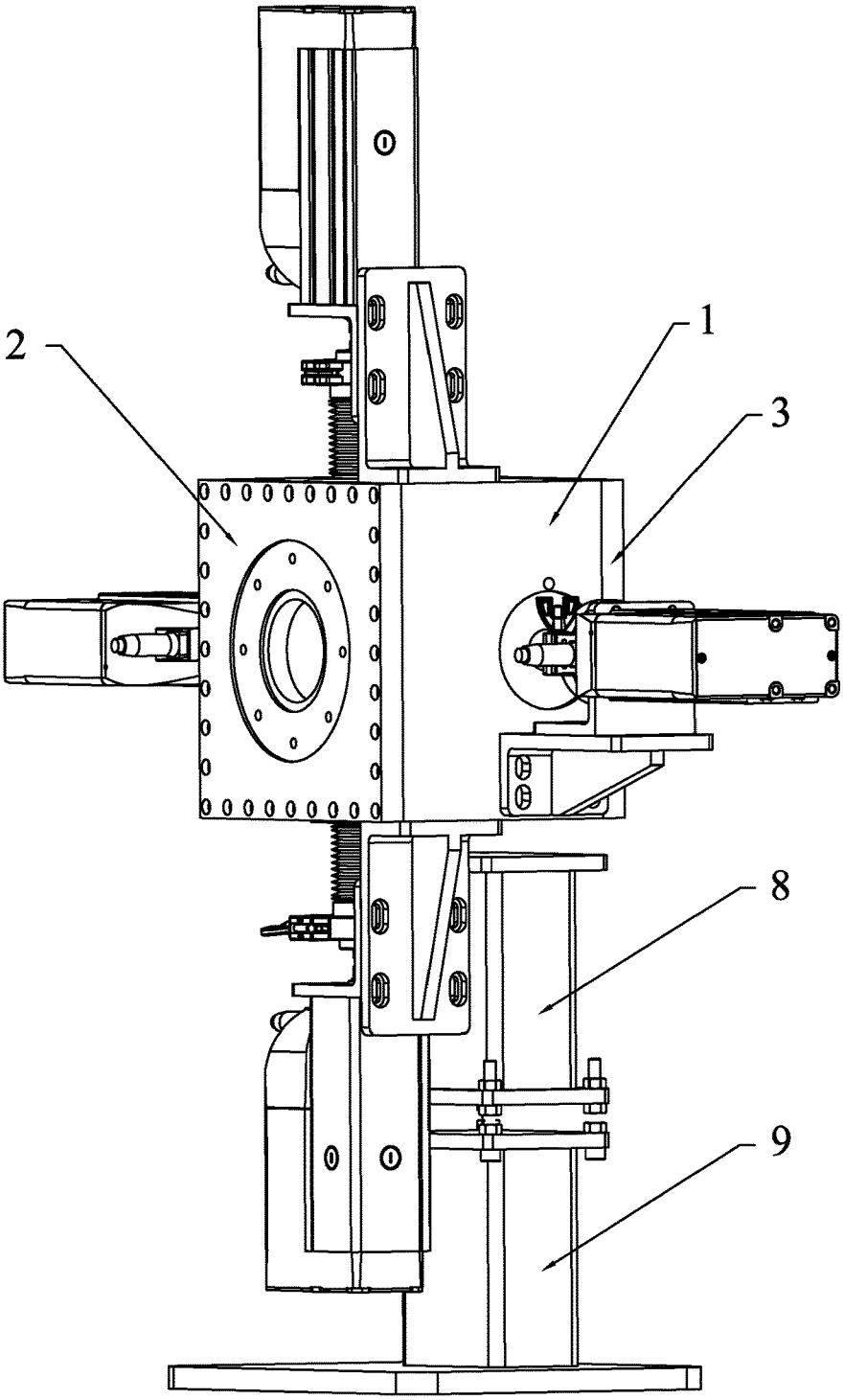
FIG. 1 is a perspective view showing the overall structure of the present disclosure.
Figure 2:
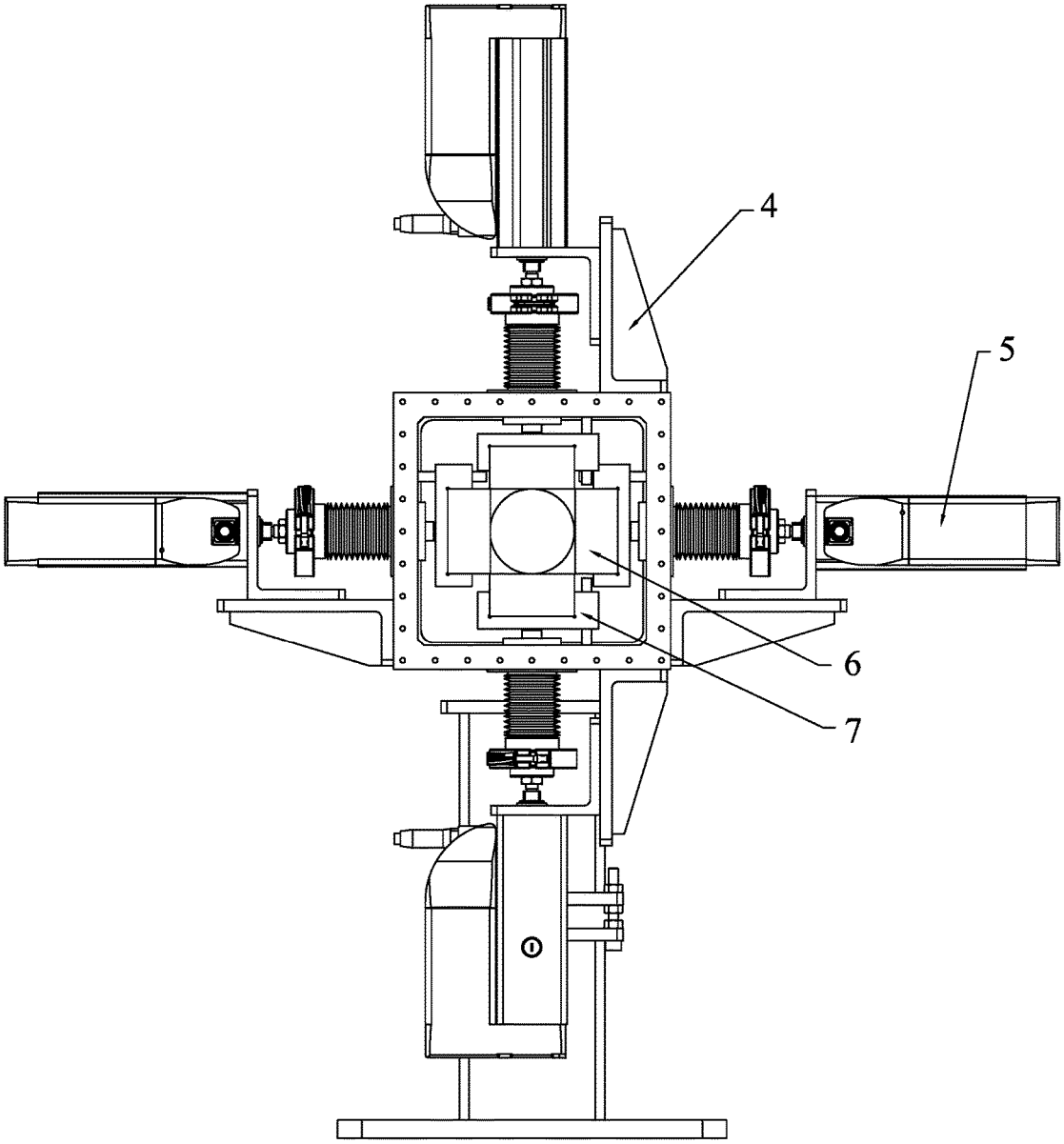
FIG. 2 is a front view showing the inside of the vacuum cavity in the overall structure of the present disclosure.

As shown in FIGS. 1 and 2, a beam energy dispersion adjusting mechanism for a superconducting proton cyclotron includes a vacuum cavity 1, a front cover 2 and a rear cover 3 respectively mounted at a first side and a second side of the vacuum cavity, and a support device mounted at a lower part of the vacuum cavity.

Bases 4 are symmetrically mounted on outer walls of the vacuum cavity 1 at four faces, and an electric cylinder 5 and a transmission mechanism are mounted on each of the four bases 4; and a jaws block 6 and a position fixing plate 7 are correspondingly provided on an inner wall of the vacuum cavity 1 at each face.

Figure 3:
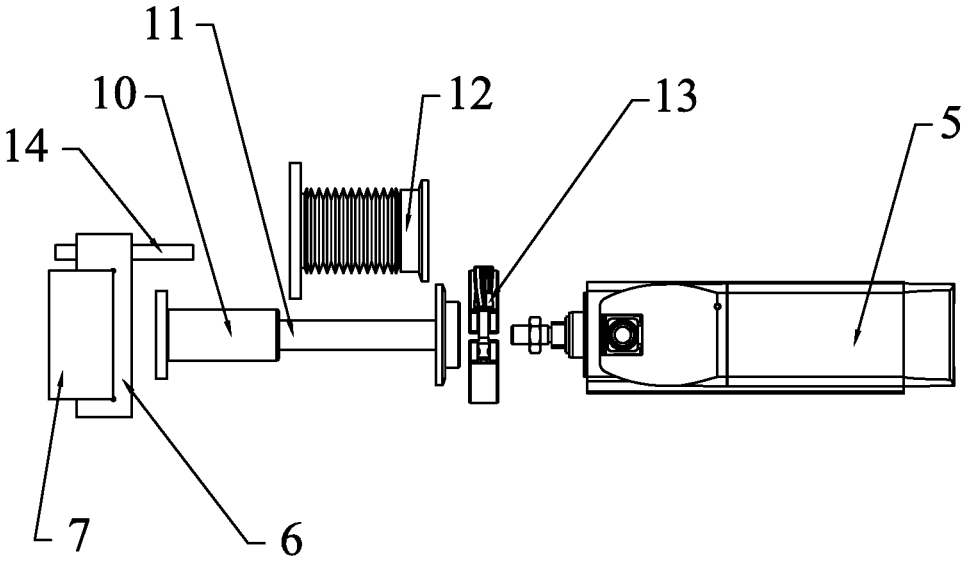
FIG. 3 is an exploded perspective view of the transmission mechanism in the overall structure of the present disclosure.

As shown in FIG. 1, the support device includes an upper support square tube 8 and a lower support square tube 9, and the upper support square tube and the lower support square tube are connected by a screw, and the height can be adjusted in real time;

As shown in FIG. 3, the transmission mechanism includes an oil-free sleeve 10, a moving connecting rod 11, a corrugated pipe 12, and an electric cylinder connecting block 13; the electric cylinder connecting block 13 serves as a connecting shaft, and both ends thereof are respectively connected with the moving connecting rod 11 and the electric cylinder 5 through threads. The oil-free sleeve 10 is fixed onto the inner wall of the vacuum cavity, and facilitates the guidance of the moving connecting rod 11. Both ends of the corrugated pipe 12 are respectively fixed to the outer wall of the vacuum cavity and the electric cylinder connecting block 13 through flanges, to ensure the vacuum degree of the working environment; the moving connecting rod 11 is provided within the corrugated pipe 12 and the oil-free sleeve 10.

As shown in FIG. 2 and FIG. 3, the position fixing plate 7 is fixed onto the moving connecting rod 11 by a screw, the jaws block 6 is insulated from the position fixing plates 7 by the non-metallic material coated on the surface of the jaws block 6, the position fixing plate 7 is U-shaped, and the jaws block 6 and the position fixing plate 7 are fixedly connected by a screw; the position fixing plate 7 is mounted on a guide rod 14, and the guide rod 14 is fixed onto the inner wall of the vacuum cavity to prevent the jaws block 6 from rotating during the linear movement which might affect adjustment precision.

The specific working principle of the present disclosure is as follows: the electric cylinder 5 is connected to a controller, the controller reads positional data from a database and sends a position command to the electric cylinder 5; the electric cylinder 5 makes a corresponding action and drives the moving connecting rod 11 to drive the linear motion of the jaws block 6; two sets of jaws blocks in the present disclosure are respectively placed in the horizontal and vertical directions, respectively adjusting the energy spread of proton beams in the two directions, and each jaws block is independently driven by the electric cylinder, and the electric cylinder has a self-contained encoder which can record the linear displacement of the jaws block and feed it back into the control system so as to precisely control the energy spread of proton beam and to obtain an ideal Bragg peak.

The preferred embodiments of the disclosure disclosed above are merely illustrative of the disclosure. The preferred embodiments have not specified all the details, and the present disclosure is not limited to the above-described specific embodiments. Obviously, many modifications and variations can be made according to the contents of the disclosure. These embodiments are selected and specifically described to explain the principle and practical applications of the disclosure, such that those skilled in the art can better understand and use the disclosure. The disclosure is only limited 1*w* the claims and their full scopes and equivalents.

What is claimed is:

1. A beam energy dispersion adjusting mechanism for a superconducting proton cyclotron, comprising a vacuum cavity; wherein bases are symmetrically mounted on four sides of an outer wall of the vacuum cavity; an electric cylinder and a transmission mechanism are mounted on each of the four bases;

a jaws block and a position fixing plate are correspondingly provided on an inner wall of the vacuum cavity at each face;

the transmission mechanism comprises an oil-free sleeve, a moving connecting rod, a corrugated pipe and an electric cylinder connecting block;

both ends of the electric cylinder connecting block are respectively connected with the moving connecting rod and the electric cylinder through threads;

the position fixing plate is fixed onto the moving connecting rod; and the jaws block is fixedly connected with the position fixing plate.

2. The beam energy dispersion adjusting mechanism according to claim 1, wherein a front cover and a rear cover are respectively mounted on a first side and a second side of the vacuum cavity; a lower part of the vacuum cavity is mounted on a support device;

the support device comprises an upper support square tube and a lower support square tube; and the upper support square tube and the lower support square tube are connected through a screw.

3. The beam energy dispersion adjusting mechanism according to claim 1, wherein the oil-free sleeve is fixed onto the inner wall of the vacuum cavity;

both ends of the corrugated pipe are respectively fixed to the outer wall of the vacuum cavity and the electric cylinder connecting block through flanges; and the moving connecting rod is provided within the corrugated pipe and the oil-free sleeve.

4. The beam energy dispersion adjusting mechanism according to claim 1, wherein the jaws block is insulated from the position fixing plate by a non-metallic material coated on a surface of the jaws block;

the position fixing plate is mounted on a guide rod; and the guide rod is fixed onto the inner wall of the vacuum cavity.

5. The beam energy dispersion adjusting mechanism according to claim 1, wherein the electric cylinder drives the moving connecting rod so as to drive the jaws block to perform a linear motion.

6. A method for adjusting the beam energy dispersion adjusting mechanism of claim 1, comprising:

1) connecting the electric cylinder to a controller; reading a positional data from a database and sending a position command to the electric cylinder by the controller;

2) performing a corresponding action and driving the moving connecting rod by the electric cylinder according to the position command so as to drive the jaws block to perform the linear motion; and 3) independently driving the each jaws block placed in the horizontal and vertical directions by the electric cylinder; and recording a linear displacement of the jaws block through a self-contained encoder of the electric cylinder and feeding it back into the controller, so as to control the energy spread of proton beam.

* * * * *